US007497149B2

(12) United States Patent
Lin

(10) Patent No.: US 7,497,149 B2
(45) Date of Patent: Mar. 3, 2009

(54) HAND TOOL WITH ADJUSTABLE HANDLE

(76) Inventor: Yi-Ting Lin, No. 113, Lane 60, Gong-Jiew Street, Ta-Li City, Taichung County (TW)

( * ) Notice: Subject to any disclaimer, the term of this patent is extended or adjusted under 35 U.S.C. 154(b) by 5 days.

(21) Appl. No.: 11/821,283

(22) Filed: Jun. 22, 2007

(65) Prior Publication Data

US 2008/0006123 A1 Jan. 10, 2008

(30) Foreign Application Priority Data

Jun. 26, 2006 (TW) ..... 95211167 U

(51) Int. Cl.
*B25B 13/46* (2006.01)
*B25B 23/16* (2006.01)

(52) U.S. Cl. ..... 81/62; 81/177.2; 403/109.3; 403/377

(58) Field of Classification Search ..... 81/62, 81/177.2; 16/429; 294/19.2; 403/109.1–109.8, 403/377, 379.1–379.6
See application file for complete search history.

(56) References Cited

U.S. PATENT DOCUMENTS 3,227,015 A * 1/1966 Tremblay ..... 81/177.2
6,006,634 A * 12/1999 Byers ..... 81/465
6,761,094 B2 * 7/2004 Tobako ..... 81/177.2
6,959,629 B2 * 11/2005 Hsien ..... 81/177.2
7,434,495 B2 * 10/2008 Lin ..... 81/177.2

* cited by examiner

*Primary Examiner*—D. S Meislin

(57) ABSTRACT

A hand tool includes a first part including a head and a shank which is cooperated with a second part. A positioning hole and a receiving hole are defined in the shank and located on two parallel axes of the shank. A block is received in the positioning hole and a positioning unit is received in the receiving hole. The second part is movably mounted to the shank and has a longitudinal slot with which the block is movably engaged. Two positioning notches are defined in the second part and the bead of the positioning unit is removably engaged with one of the positioning notches. A first recess, a second recess and a third recess are defined in communication with the slot so as to receive the block during adjusting the length of the handle of the hand tool.

13 Claims, 8 Drawing Sheets

HAND TOOL WITH ADJUSTABLE HANDLE

FIELD OF THE INVENTION

The present invention relates to an adjustable handle for a hand tool.

BACKGROUND OF THE INVENTION

A conventional hand tool such as a ratchet wrench generally includes a handle and a head connected to the handle, a ratchet mechanism is received in the head so as to change the direction for output of torque. Nevertheless, the conventional hand tool includes a fixed handle whose length cannot be adjusted so that the handle occupies a certain space when being received in a tool box or being used in a narrow space.

The present invention intends to provide an adjustable handle for a hand tool wherein the handle is composed of several sections which are retractably connected to each other. The handle is rotated an angle and then adjusted its length.

SUMMARY OF THE INVENTION

The present invention relates to a hand tool which comprises a first part which includes a head and a shank extending from the head. A switch device and a ratchet mechanism are received in the head. A positioning hole and a receiving hole are defined in the shank and located on two parallel axes of the shank. A first end of a block is received in the positioning hole and a positioning unit is received in the receiving hole. A second part is movably mounted to the shank and has a longitudinal slot with which a second end of the block is movably engaged. Two positioning notches are defined in the second part and the bead is removably engaged with one of the positioning notches. A first recess, a second recess and a third recess are defined in communication with the slot. An angle is defined between an axis of the third recess and an axis of the slot such that a distal inner end of the third recess is located beyond a distal end of the slot in a longitudinal direction of the slot.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
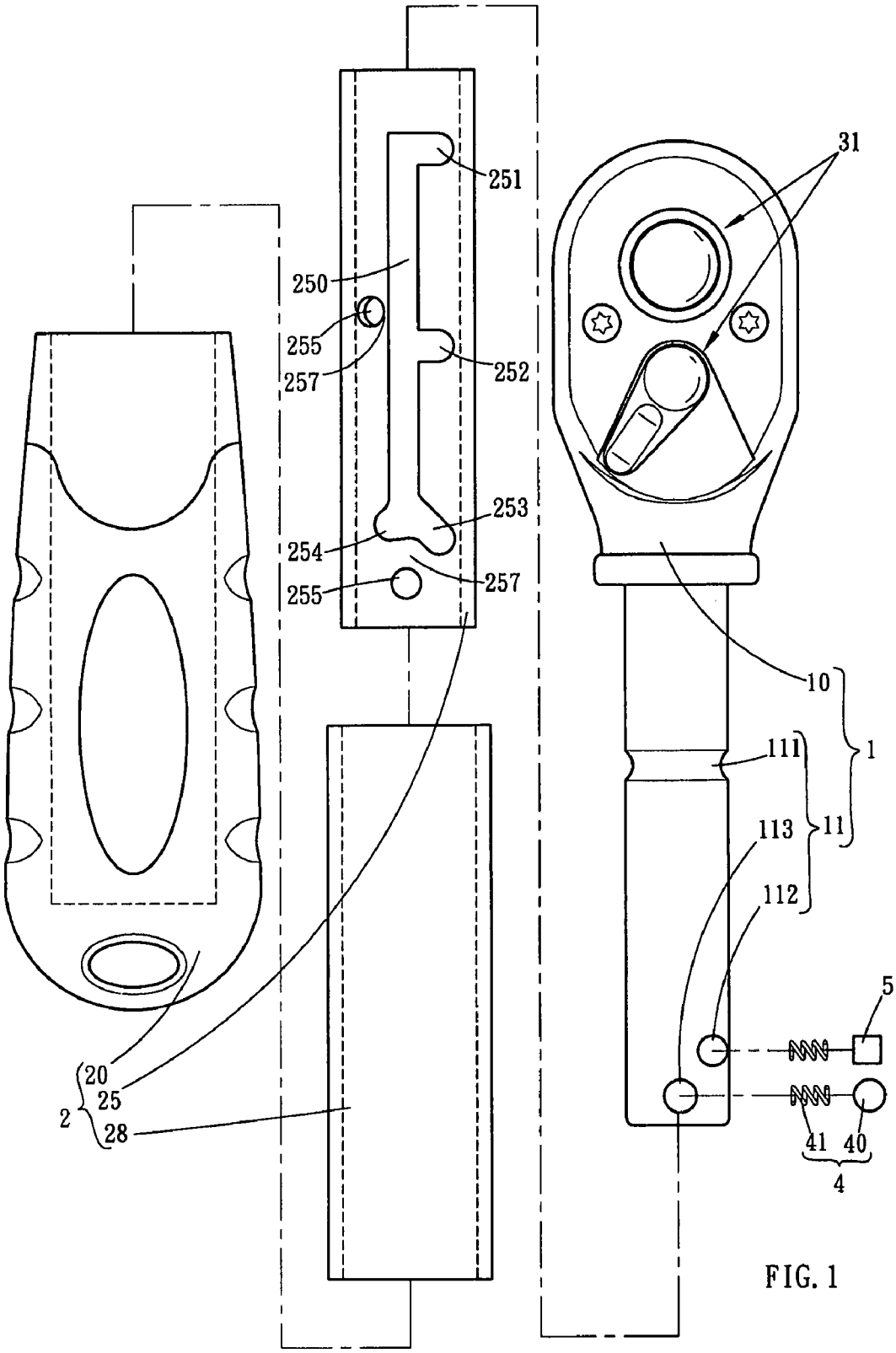
FIG. 1 is an exploded view to show a first embodiment of the hand tool of the present invention.

Referring to FIGS. 1 to 9, the hand tool of the present invention comprises a first part 1 having a head 10 and a shank 11 extending from the head 10. A switch device 30 and a ratchet mechanism 31 are received in the head 10. A positioning hole 112 and a receiving hole 113 are defined in the shank 11 and located on two parallel axes of the shank 11. An annular groove 111 is defined in an outer periphery of the shank 11. A first end of a block 5 is received in the positioning hole 112 and a spring is biased between the block 5 and an inner end of the positioning hole 112. A positioning unit 4 is received in the receiving hole 113 and includes a bead 40 and a spring 41 which biases the bead 40.

A second part 2 is movably mounted to the shank 11 and includes a grip 20 with an open end, a first tube 25 and a second tube 28 which is received in the grip 20 and the first tube 25 is received in the second tube 28. The first tube 25 includes a longitudinal slot 250 with which a second end of the block 5 is movably engaged. Two positioning notches 255 are defined in the second part 2 and a separation portion 257 is located between each of the positioning notches 255 and the slot 250. A first recess 251, a second recess 252 and a third recess 253 are defined in communication with the slot 250. The first, second and third recesses 251, 252, 253 are located on the same side of the slot 250. An angle is defined between an axis of the third recess 253 and an axis of the slot 250 such that a distal inner end of the third recess 253 is located beyond a distal end of the slot 250 in a longitudinal direction of the slot 250. A fourth recess 254 is defined in communication with the slot 250 and an angle is defined between an axis of the fourth recess 254 and the axis of the slot 250 such that a distal inner end of the fourth recess 254 is located beyond the distal end of the slot 250 in a longitudinal direction of the slot 250. A longitudinal distance beyond the distal end of the slot 250 of the fourth recess 254 is shorter than the longitudinal distance beyond the distal end of the slot 250 of the third recess 253. The third recess 253 and the fourth recess 254 are located on opposite sides of the slot 250.

Figure 2:
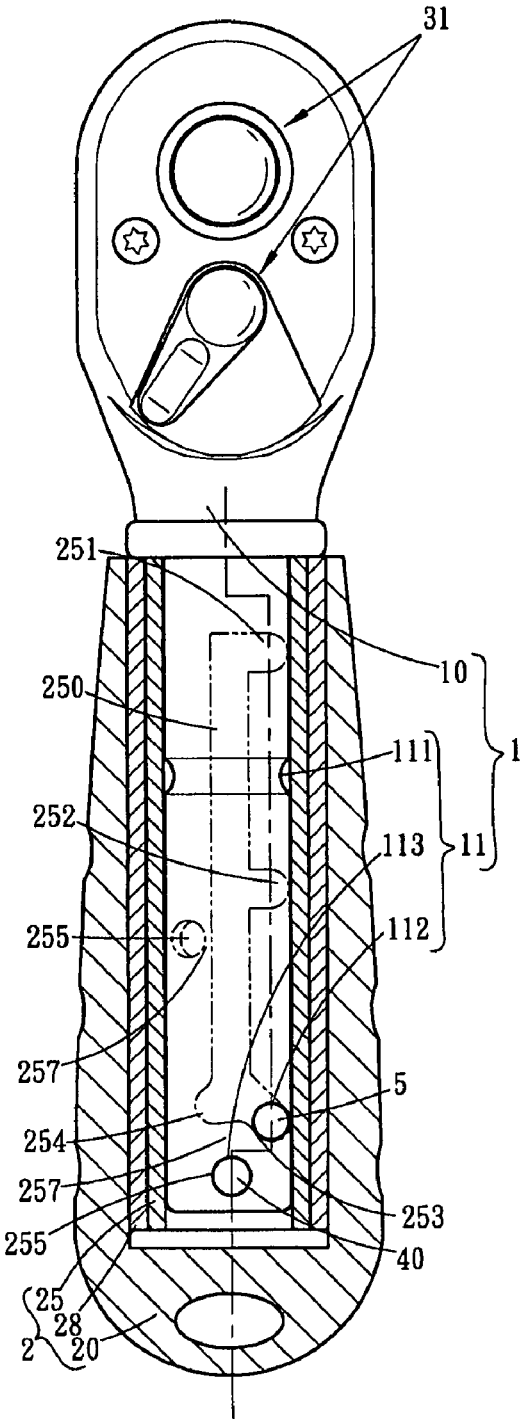
FIG. 2 is a cross sectional view to show the hand tool in FIG. 1.
Figure 4:
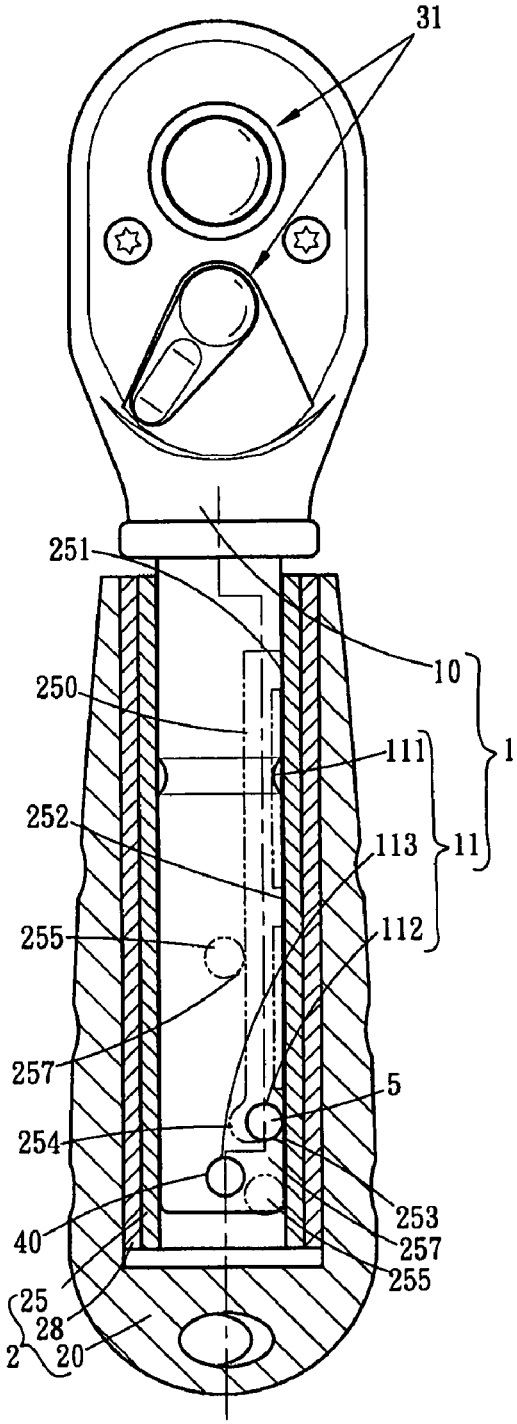
FIG. 4 is a cross sectional view to show that the second part of FIG. 2 is rotated an angel.
Figure 3:
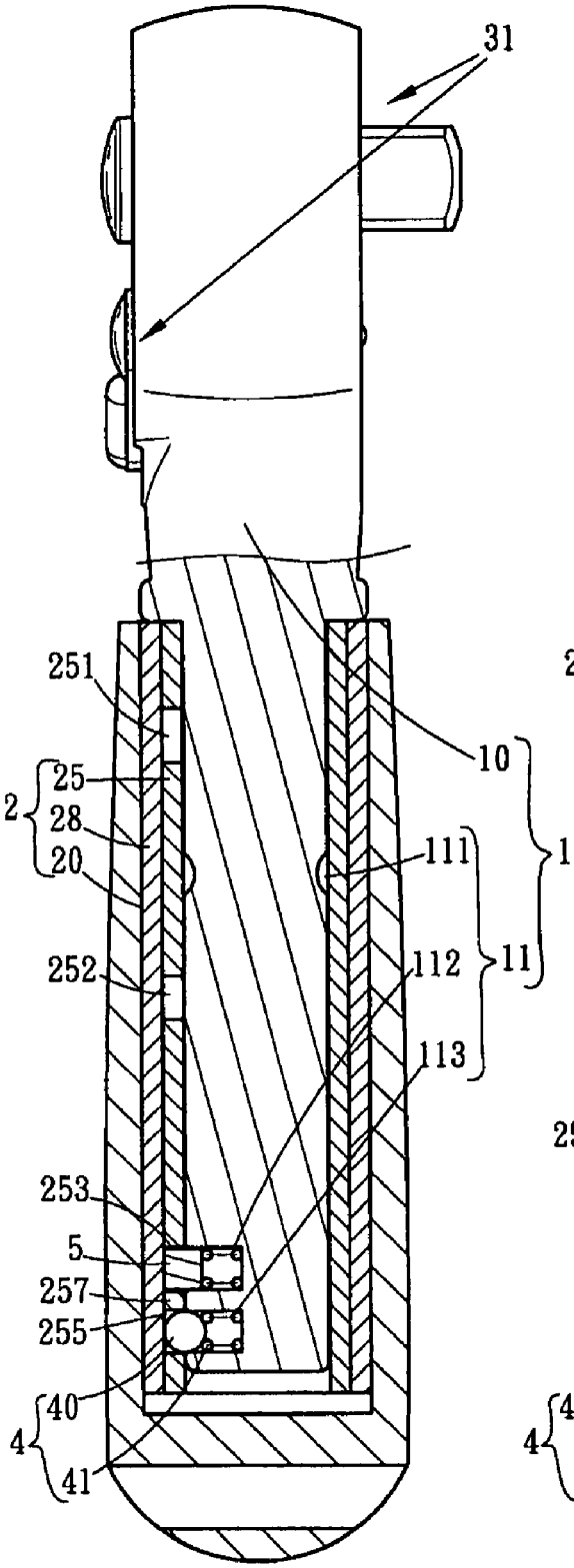
FIG. 3 is a cross sectional view from another angle of the hand tool in FIG. 1.
Figure 5:
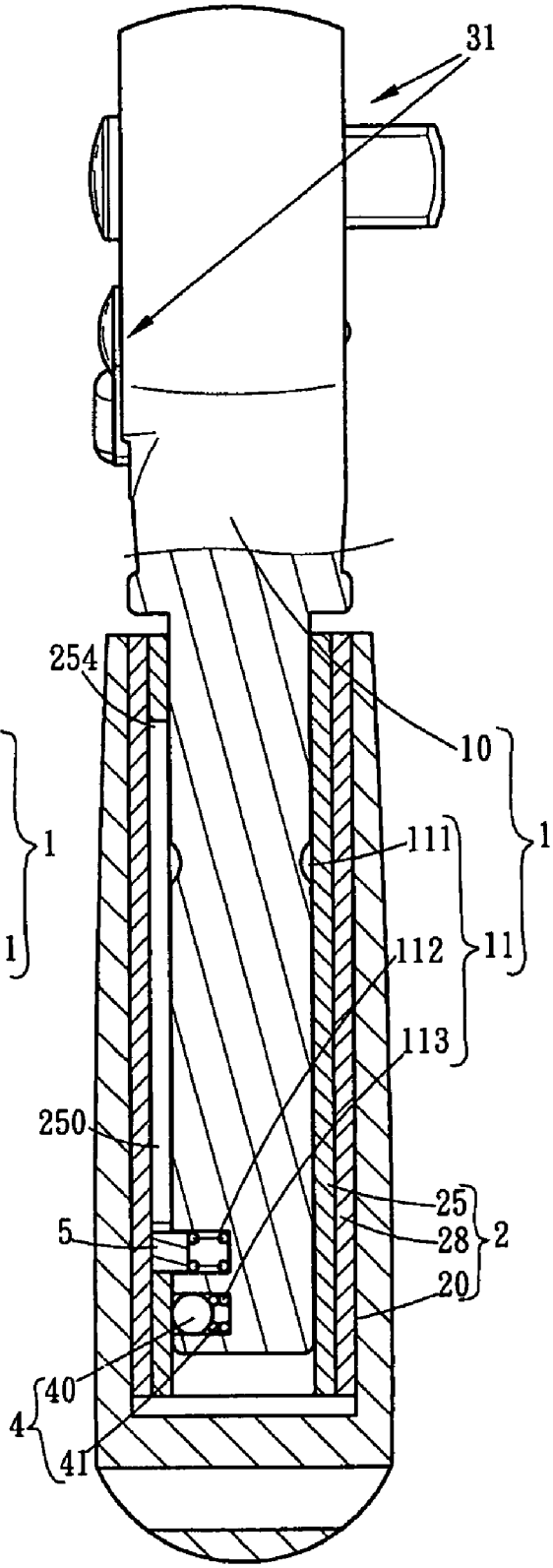
FIG. 5 shows a cross sectional view from another angle of the hand tool in FIG. 4.
Figure 6:
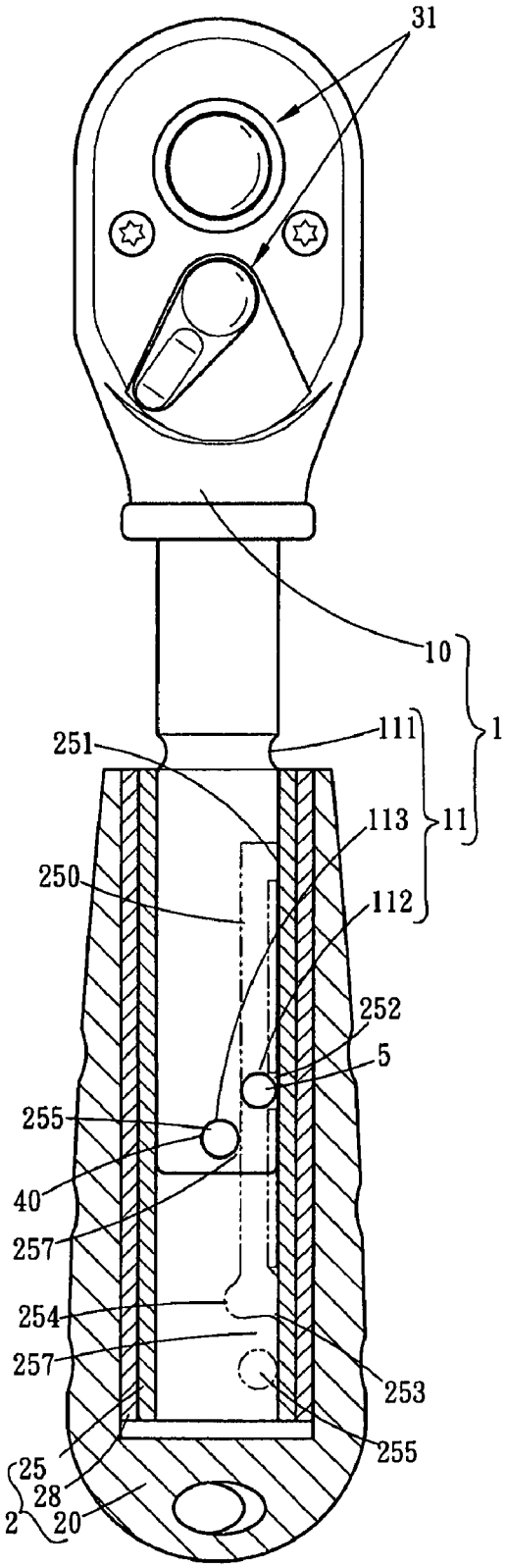
FIG. 6 shows the second part is pulled relative to the first part in the status of FIG. 4.
Figure 7:
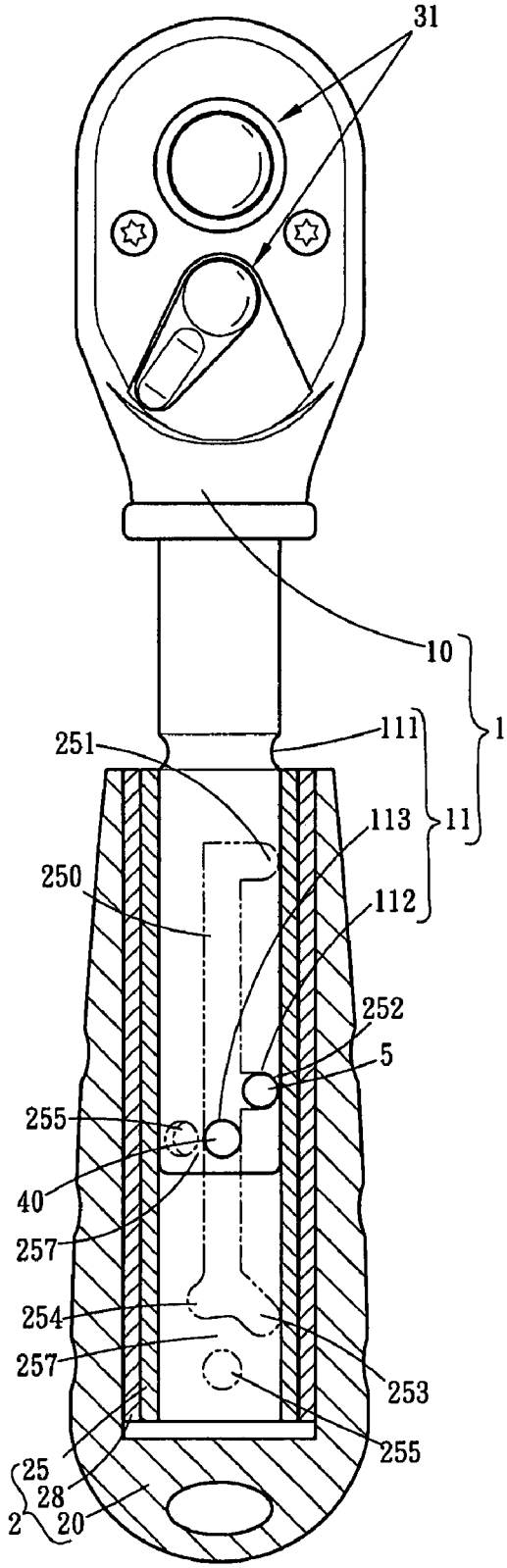
FIG. 7 shows the second part in FIG. 6 is rotated an angle.

As shown in FIGS. 2 and 3, the block 5 is engaged with the third recess 253 and the bead 40 is engaged with the lower positioning notch 255, when rotating the second part 2 an angle, the block 5 is moved to the slot 250 and the bead 40 is removed from the positioning notch 255 as shown in FIGS. 4 and 5. As shown in FIGS. 6 and 7, the second part 2 is then pulled relative to the first part 1, the position of the groove 111 is moved to a top of the second part 2 and the bead 40 is engaged with the higher positioning notch 255 to acknowledge the user that the first adjustment is achieved. If the length of the handle is acceptable to the user, the user rotates the second part 2 to move the block 5 into the second recess 252 and the bead 40 is moved in the slot 250.

Figure 8:
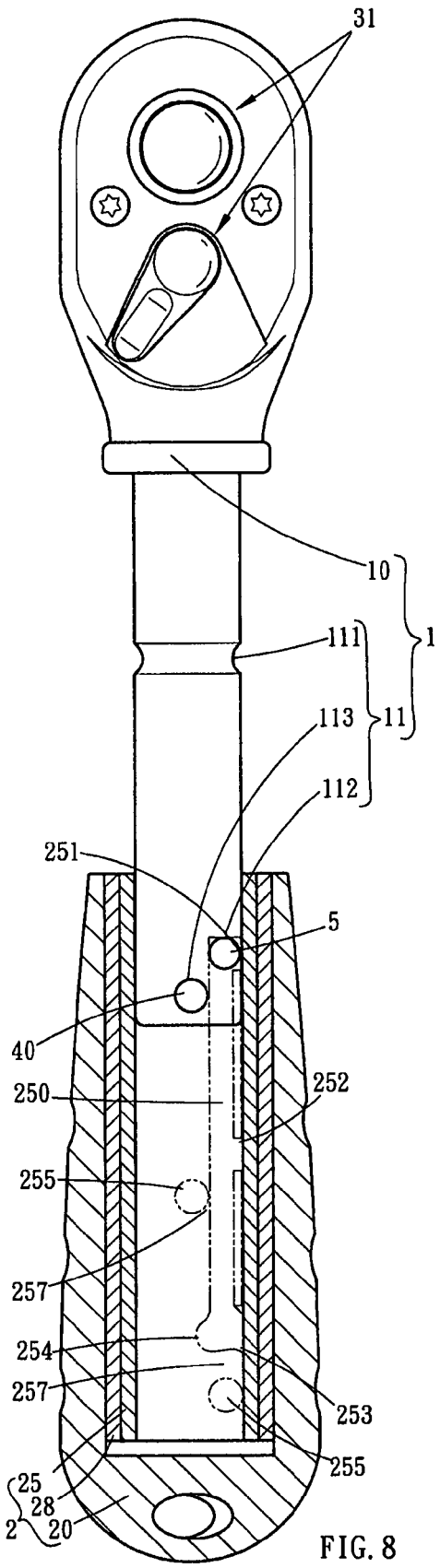
FIG. 8 shows the second part is further pulled in the status of FIG. 4.
Figure 9:
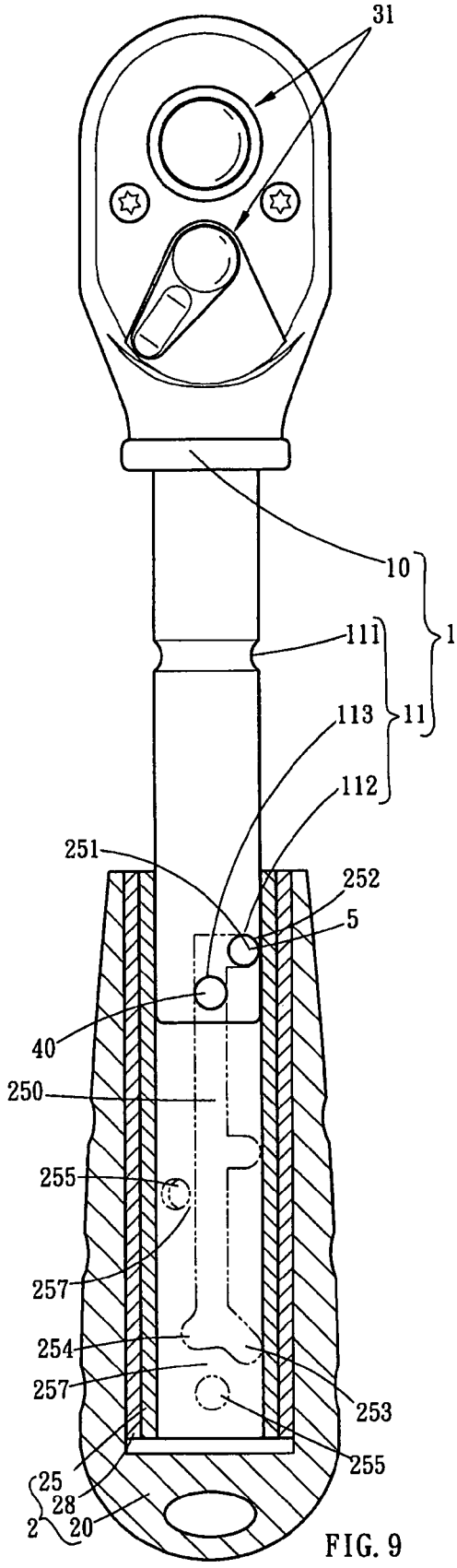
FIG. 9 shows the second part in FIG. 8 is rotated an angle.

As shown in FIGS. 8 and 9, if the handle is needed to be further longer, the second part 2 is rotated an angle to move the bead 40 over the separation portion 257 and is inserted into the higher positioning recess 255 and the block 5 is moved to the slot 250, so that the user may pull the second part 2 till the block 5 moves to an end of the slot 250. The second part 2 is then rotated an angle to move the bead 40 into the slot 250 and the block 5 into the first recess 251.

When retracting the handle, the second part 2 is rotated clockwise and the block 5 is moved into the slot 250 and the second part 2 is pushed upward till the block 5 is moved into the fourth recess 254 as shown in FIG. 4. Because the longitudinal distance beyond the distal end of the slot 250 of the fourth recess 254 is shorter than the longitudinal distance beyond the distal end of the slot 250 of the third recess 253, so that when the block 5 is moved into the fourth recess 254, there will be a gap defined between the top of the second part 2 and the head 10, when the second part 2 is further rotated counterclockwise, the block 5 is guided by the tilt third recess 253 to move the second part 2 toward left and upward till the top of the second part 2 contacts the head 10, or till the bead 40 is engaged with the positioning notch 255. By this way, the user's finger is not squeezed by the adjustment.

Figure 10:
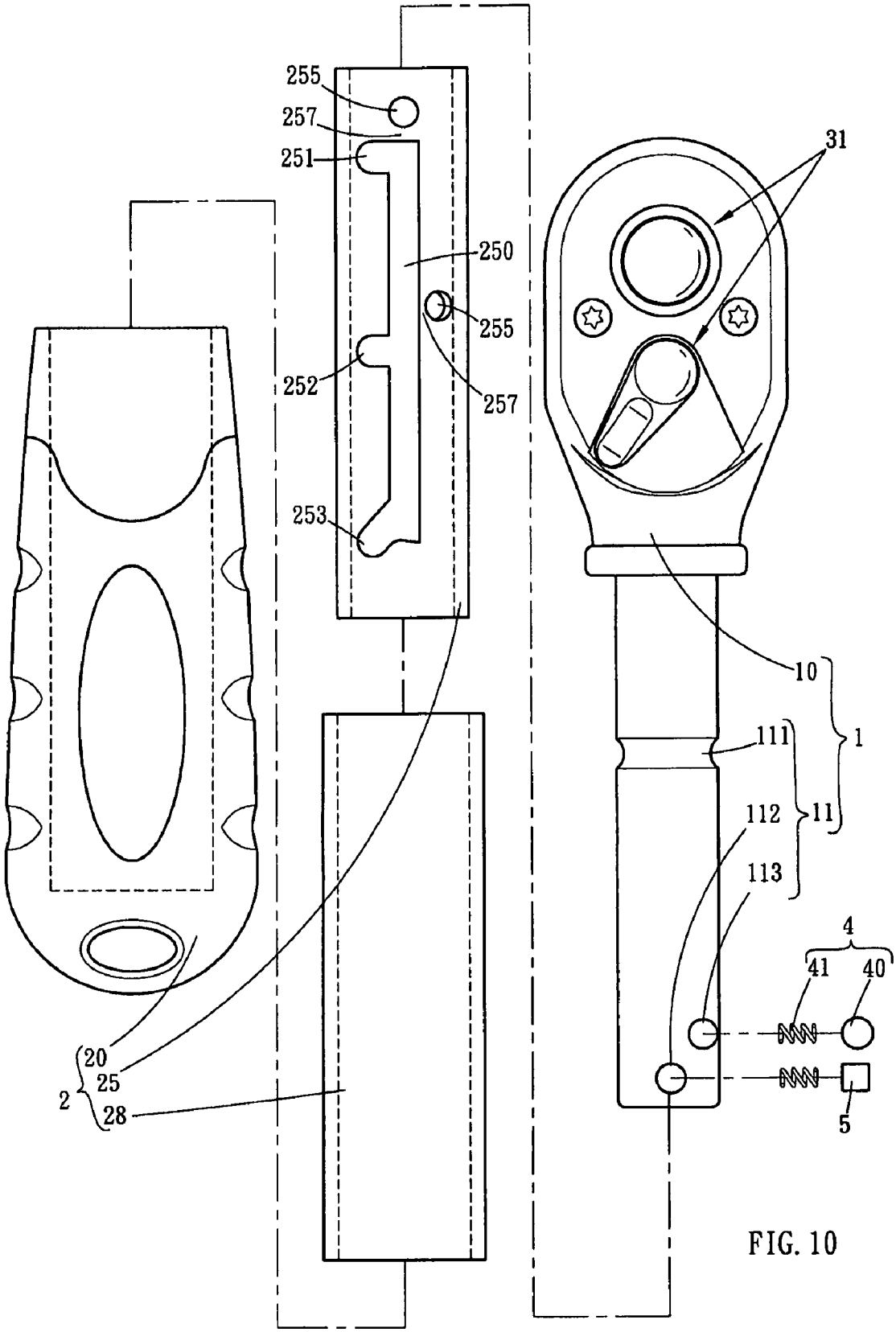
FIG. 10 is a second embodiment of the hand tool of the present invention.

FIG. 10 is a second embodiment of the hand tool wherein the difference from the first embodiment is that the fourth recess 254 is omitted and the first, second and the third recesses 251, 252, 253 of the first tube 25 are located on the left side of the slot 250, the two positioning notches 255 are located on a top of the slot 250 and on the right side of the slot 250.

Figure 11:
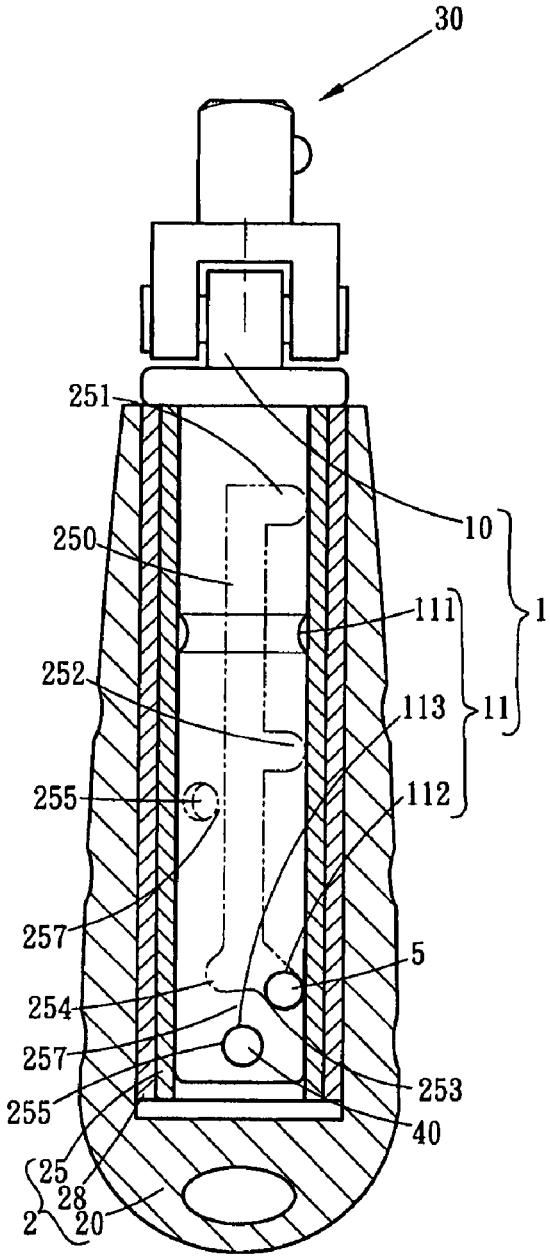
FIG. 11 shows a third embodiment of the hand tool of the present invention.
Figure 12:
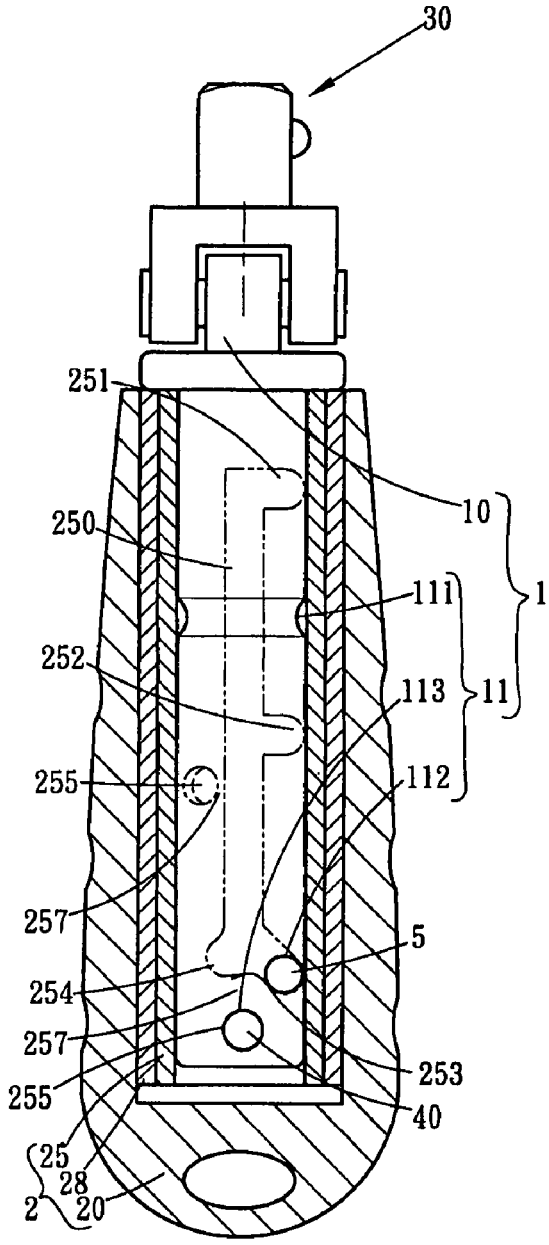
FIG. 12 shows a fourth embodiment of the hand tool of the present invention.

FIG. 11 shows a third embodiment, wherein the difference from the first embodiment is that the head 10 is pivotably connected to the shank 11. FIG. 12 shows a fourth embodiment, wherein the difference from the first embodiment is that the head 10 is pivotably connected to the switch device 11.

Figure 13:
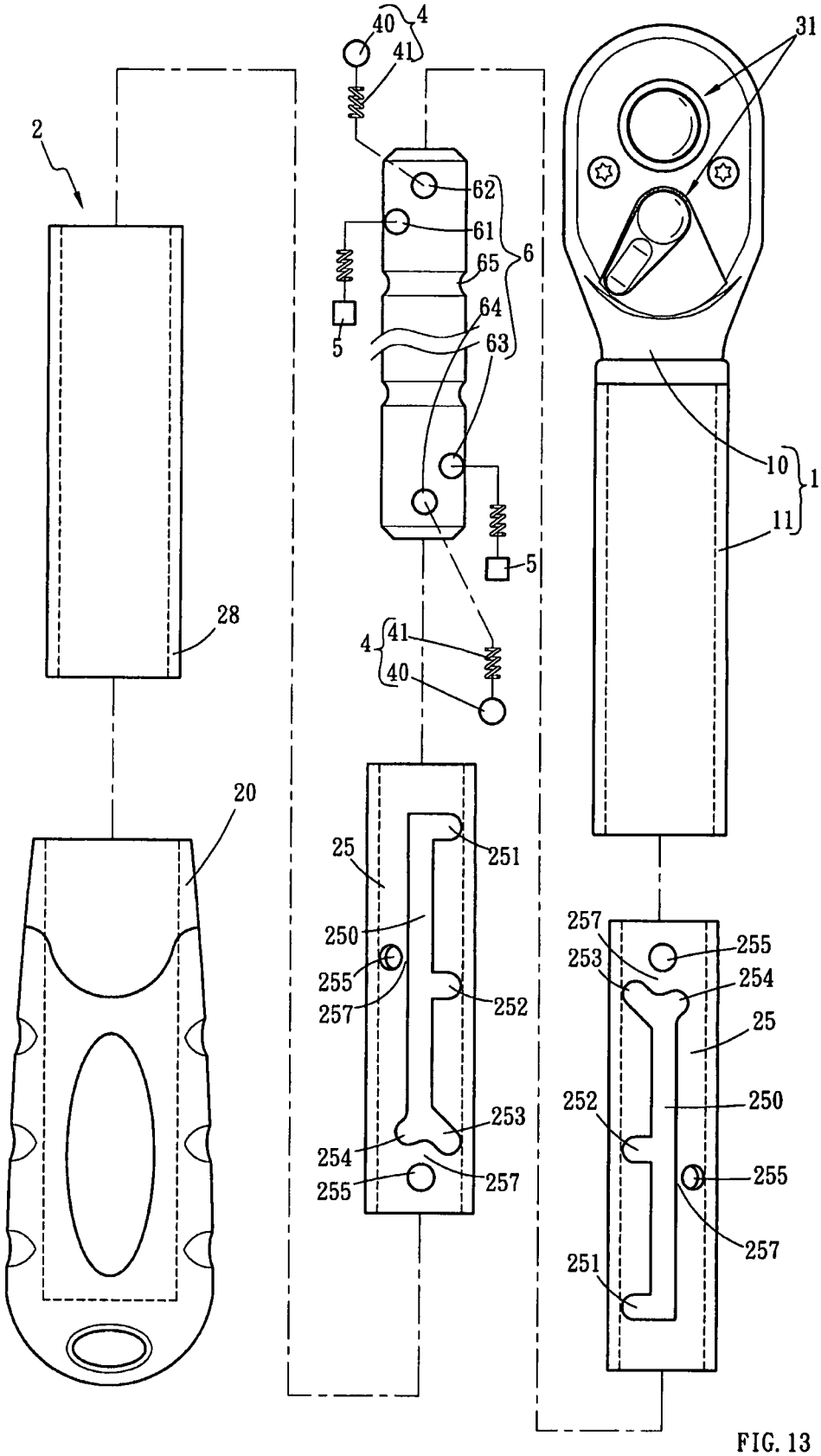
FIG. 13 shows a fifth embodiment of the hand tool of the present invention.

FIG. 13 shows a fifth embodiment of the hand tool, wherein the shank 11 including an open end and the second part 2 includes a grip 20 with an open end, two first tubes 25, a second tube 28 and a connection rod 6 which has a groove 65 defined in an outer periphery thereof. One of the two first tubes 25 and the second tube 28 and the connection rod 6 are received in the grip 20 wherein the first tube 25 is received in the second tube 28, and the other first tube 25 is received in the shank 11. Each of the two first tubes 25 includes a longitudinal slot 250, a first recess 251, a second recess 252 and a third recess 253 defined in communication with the slot 250. An angle is defined between an axis of the third recess 253 and an axis of the slot 250 such that a distal inner end of the third recess 253 is located beyond a distal end of the slot 250 in a longitudinal direction of the slot 250. A fourth recess 254 is defined in communication with the slot 250. The third recess 253 and the fourth recess 254 are located on opposite sides of the slot 250. The two respective fourth recesses 254 of the two first tubes 25 are arranged to be located on two remote ends of the two first tubes 25.

Each of two ends of the connection rod 6 includes a positioning hole 61/63 and a receiving hole 62/64. The positioning hole 61/63 and the receiving hole 62/64 are located on two parallel axes of the connection rod 6. Two positioning units 4 are received in the two receiving holes 62, 64 and two blocks 5 are located in the two positioning holes 61, 63. Each positioning unit 4 has a bead 40 and the two respective beads 40 are respectively and movably engaged with the two respective slots 250 of the two first tubes 25. An angle defined between an axis of the fourth recess 254 and the axis of the slot 250 such that a distal inner end of the fourth recess 254 is located beyond a distal end of the slot 250 in a longitudinal direction of the slot 250. A longitudinal distance beyond the distal end of the slot 250 of the fourth recess 254 is shorter than the longitudinal distance beyond the distal end of the slot 250 of the third recess 253.

While we have shown and described the embodiment in accordance with the present invention, it should be clear to those skilled in the art that further embodiments may be made without departing from the scope of the present invention.

What is claimed is:

1. A hand tool comprising:

a first part having a head and a shank extending from the head, a switch device and a ratchet mechanism received in the head, a positioning hole and a receiving hole defined in the shank and located on two parallel axes of the shank, a first end of a block received in the positioning hole and a positioning unit received in the receiving hole, the positioning unit including a bead, and a second part movably mounted to the shank and having a longitudinal slot with which a second end of the block is movably engaged, two positioning notches defined in the second part and the bead being removably engaged with one of the positioning notches, a first recess, a second recess and a third recess defined in communication with the slot, an angle defined between an axis of the third recess and an axis of the slot such that a distal inner end of the third recess is located beyond a distal end of the slot in a longitudinal direction of the slot.

2. The hand tool as claimed in claim 1, wherein a fourth recess is defined in communication with the slot and an angle defined between an axis of the fourth recess and the axis of the slot such that a distal inner end of the fourth recess is located beyond a distal end of the slot in a longitudinal direction of the slot, a longitudinal distance beyond the distal end of the slot of the fourth recess is shorter than the longitudinal distance beyond the distal end of the slot of the third recess.

3. The hand tool as claimed in claim 1, wherein the positioning unit includes a spring and the bead which is biased by the spring.

4. The hand tool as claimed in claim 1, wherein a spring is biased between the block and an inner end of the positioning hole.

5. The hand tool as claimed in claim 1, wherein the second part is a grip with an open end and the longitudinal slot, the first recess, the second recess and the third recess are defined in an inner periphery of the second part, a fourth recess is defined in communication with the slot, the third recess and the fourth recess are located on opposite sides of the slot.

6. The hand tool as claimed in claim 1, wherein the second part includes a grip with an open end and a first tube, the longitudinal slot, the first recess, the second recess and the third recess are defined in an outer periphery of the first tube, a fourth recess is defined in communication with the slot, the third recess and the fourth recess are located on opposite sides of the slot.

7. The hand tool as claimed in claim 5 or 6, wherein the shank includes a groove defined in an outer periphery thereof.

8. A hand tool comprising:

a first part having a head and a shank extending from the head, a switch device and a ratchet mechanism received in the head, the shank including an open end;

a second part including a grip with an open end, two first tubes, a second tube and a connection rod, one of the two first tubes and the second tube and the connection rod received in the grip wherein the first tube is received in the second tube, the other first tube received in the shank, each of the two first tubes including a longitudinal slot, a first recess, a second recess and a third recess defined in communication with the slot, an angle defined between an axis of the third recess and an axis of the slot such that a distal inner end of the third recess is located beyond a distal end of the slot in a longitudinal direction of the slot, a fourth recess defined in communication with the slot, the third recess and the fourth recess are located on opposite sides of the slot, each of two ends of the connection rod including a positioning hole and a receiving hole, the positioning hole and the receiving hole being located on two parallel axes of the connection rod, and two positioning units received in the two receiving holes and two blocks located in the two positioning holes, each positioning unit having a bead and the two respective beads respectively and movably engaged with the two respective slots of the two first tubes.

9. The hand tool as claimed in claim 8, wherein an angle defined between an axis of the fourth recess and the axis of the slot such that a distal inner end of the fourth recess is located beyond a distal end of the slot in a longitudinal direction of the slot, a longitudinal distance beyond the distal end of the slot of the fourth recess is shorter than the longitudinal distance beyond the distal end of the slot of the third recess.

10. The hand tool as claimed in claim 8, wherein each positioning unit includes a spring and the bead which is biased by the spring.

11. The hand tool as claimed in claim 8, wherein a spring is biased between each block and an inner end of the positioning hole.

12. The hand tool as claimed in claim 8, wherein the connection rod includes a groove defined in an outer periphery thereof.

13. The hand tool as claimed in claim 8, wherein the two respective fourth recesses of the two first tubes are arranged to be located on two remote ends of the two first tubes.

* * * * *